US005307524A

United States Patent [19]

Veal

[11] Patent Number: 5,307,524

[45] Date of Patent: May 3, 1994

[54] AUTOMATIC TOILET SEAT DEVICE

[76] Inventor: Bennie N. Veal, 27336 Aberdeen, Southfield, Mich. 48076

[21] Appl. No.: 55,212

[22] Filed: Apr. 29, 1993

Related U.S. Application Data

[63] Continuation-in-part of Ser. No. 857,462, Mar. 25, 1992, abandoned.

[51] Int. Cl.[5] ..... A47K 13/10

[52] U.S. Cl. ..... 4/246.1; 4/246.2; 4/406

[58] Field of Search ..... 4/246.1, 246.2, 406; 220/211

[56] References Cited

U.S. PATENT DOCUMENTS

| | | | |
|---|---|---|---|
| 2,219,044 | 10/1940 | Horr | 4/246.1 |
| 2,440,231 | 10/1944 | Davidson | 4/246.1 |
| 3,284,810 | 11/1966 | Stokes | 4/246.1 |
| 3,404,411 | 10/1968 | Newkirk | 4/246.1 |
| 4,185,336 | 1/1980 | Young | 4/406 |
| 4,459,521 | 7/1984 | Barge | 318/445 |
| 4,935,967 | 6/1990 | Cour | 4/247 |
| 4,989,277 | 2/1991 | Tsutsui et al. | 4/367 |
| 4,995,120 | 2/1991 | Tager | 4/246.1 |
| 5,036,443 | 7/1991 | Humble et al. | 4/661 |
| 5,036,553 | 8/1991 | Sanderson | 4/406 |
| 5,153,946 | 10/1992 | Yoke et al. | 4/246.1 |
| 5,187,818 | 2/1993 | Barrett, Sr. et al. | 4/406 |

FOREIGN PATENT DOCUMENTS

| | | | |
|---|---|---|---|
| 1054306 | 5/1979 | Canada | 4/246.1 |

OTHER PUBLICATIONS

"A Device That's Likely to Please Everyone", *The New York Times*, Consumer's World, Feb. 15, 1992.

*Primary Examiner*—Henry J. Recla
*Assistant Examiner*—Charles R. Eloshway
*Attorney, Agent, or Firm*—Harness, Dickey & Pierce

[57] ABSTRACT

An automatic toilet seat device which will cause a toilet seat to be either raised or lowered at the push of a single button and further, will automatically lower the toilet seat after the flush action of the toilet. A first switch associated with the device will, when activated, cause the toilet seat to be raised by an electric motor. Once the toilet user has flushed the toilet, a float switch associated with a tank of the toilet will cause the motor to lower the toilet seat. The control circuit controlling the automatic toilet seat device is microprocessor controlled and includes an over-current detection circuit. The over-current detection circuit will detect over-current in the motor when the seat is completely raised or lowered such that the microprocessor will stop the motor from turning.

27 Claims, 7 Drawing Sheets

AUTOMATIC TOILET SEAT DEVICE

CROSS-REFERENCE TO RELATED APPLICATION

This application is a continuation-in-part of U.S. application Ser. No. 07/857,462, filed Mar. 25, 1992, abandoned.

BACKGROUND OF THE INVENTION

1. Field of the Invention

This invention relates generally to an automatic toilet seat device and, more particularly, to a toilet seat incorporating an electrical device for automatically raising and lowering the toilet seat.

2. Discussion of the Background

Without need for excessive elaboration, it is generally understood that in at least one respect, whether a person is male or female usually determines in what position, either up or down, that person would prefer a toilet seat to be in for use of the toilet. Generally, a male prefers the toilet seat to be in a raised position, while the female prefers the toilet seat to be in a lowered position for conformity with their respective anatomies. Typically, due to a male's behavioral patterns, however, it is widely accepted that in at least a substantial number of cases the male will not return the toilet seat to its lowered position after his use, thus rendering the toilet unsuitable for use by a subsequent female user.

A toilet seat remaining in an upright position could lead to a number of problems. In many occasions a certain amount of animosity between the females and males in a dual gender household may arise if the females have to continually return the toilet seat to its lowered position for their use. Further complications could arise if a female, in a partially somnolent state, attempted to use the toilet in the dark when the seat was in a raised position. Moreover, a raised toilet seat leads to a certain level of unsightliness, thus, possibly causing further tension if certain members of the household attempt to maintain the bathroom area in an orderly manner. Other problems could arise for a toilet user if the toilet seat was not in the most desirable configuration for a specific user. Some of these problems include difficulty in the manual operation of lowering or raising the toilet seat by persons suffering a variety of illnesses or handicaps, or by small children.

In addition to a toilet seat remaining in a prolonged raised position, there is also a certain loss of hygiene which occurs when a user is required to physically make contact with the toilet seat to either raise or lower the seat. As is well understood, the toilet seat and toilet seat area require a high level of disinfecting maintenance in order to provide a relatively free area from bacteria and germs. Since continued disinfection of this area is generally not feasible, a toilet seat will typically not be maintained in its most sanitary condition. Consequently, any user who must physically contact the toilet seat to either raise or lower it will be subject to these germs, and thus, may put his or her health at differing levels of unnecessary risk.

What is needed then is a device which will raise or lower a toilet seat without requiring a user to physically touch the seat, and further, will automatically lower the toilet seat without any intervention from the toilet user after use. It is therefore an object of the present invention to provide such a device.

SUMMARY OF THE INVENTION

The present invention is directed to an electrical device which will either raise or lower a toilet seat by operation of a push button switch, and further, will automatically lower the toilet seat after the flushing action of the toilet. In one preferred embodiment, the shaft of an electrical motor is attached to a toilet seat substantially at a connection point where the toilet seat articulates relative to the toilet bowl. When the motor receives an appropriate electrical signal from a control circuit, it will rotate the shaft in either direction to raise or lower the toilet seat. When the toilet seat is in a lowered position, and a user wishes to raise the seat, the user will push a button positioned in a predetermined desirable location which will cause the seat to be raised. The toilet seat can then be returned to a lowered position by again pushing the same button, a separate button, or by operating a sound activated device.

If the user does not lower the toilet seat by activating the push button or sound device, the flushing action of the toilet will automatically lower the seat. Specifically, after the toilet has been flushed, a float in the toilet tank will activate a switch when the float reaches a predetermined level such that the control circuit will instruct the motor to automatically lower the seat, thus requiring no intervention by the toilet user. A timing mechanism is incorporated to delay the lowering of the seat a predetermined time after the flushing action.

In one preferred embodiment, the control circuit will detect over-current in the motor such that the control circuit can determine when the toilet seat is in a raised or lowered position when the toilet seat contacts the toilet bowl or the toilet tank. Alternately, a pair of switches may be associated with the toilet seat and/or the electrical motor to enable the device to know in what position the toilet seat is in to prevent the motor from attempting to raise or lower the seat when it is already in the raised or lowered position, respectively. Additionally, a light can be associated with the toilet seat in order to provide illumination of the toilet in the dark.

Additional objects, advantages, and features of the present invention will become apparent from the following description and appended claims, taken in conjunction with the accompanying drawings.

DETAILED DESCRIPTION OF THE DRAWINGS

The following discussion of the preferred embodiments concerning an automatic toilet seat raising and lowering device is merely exemplary in nature and is in no way intended to limit the invention or its application or uses.

Figure 1:
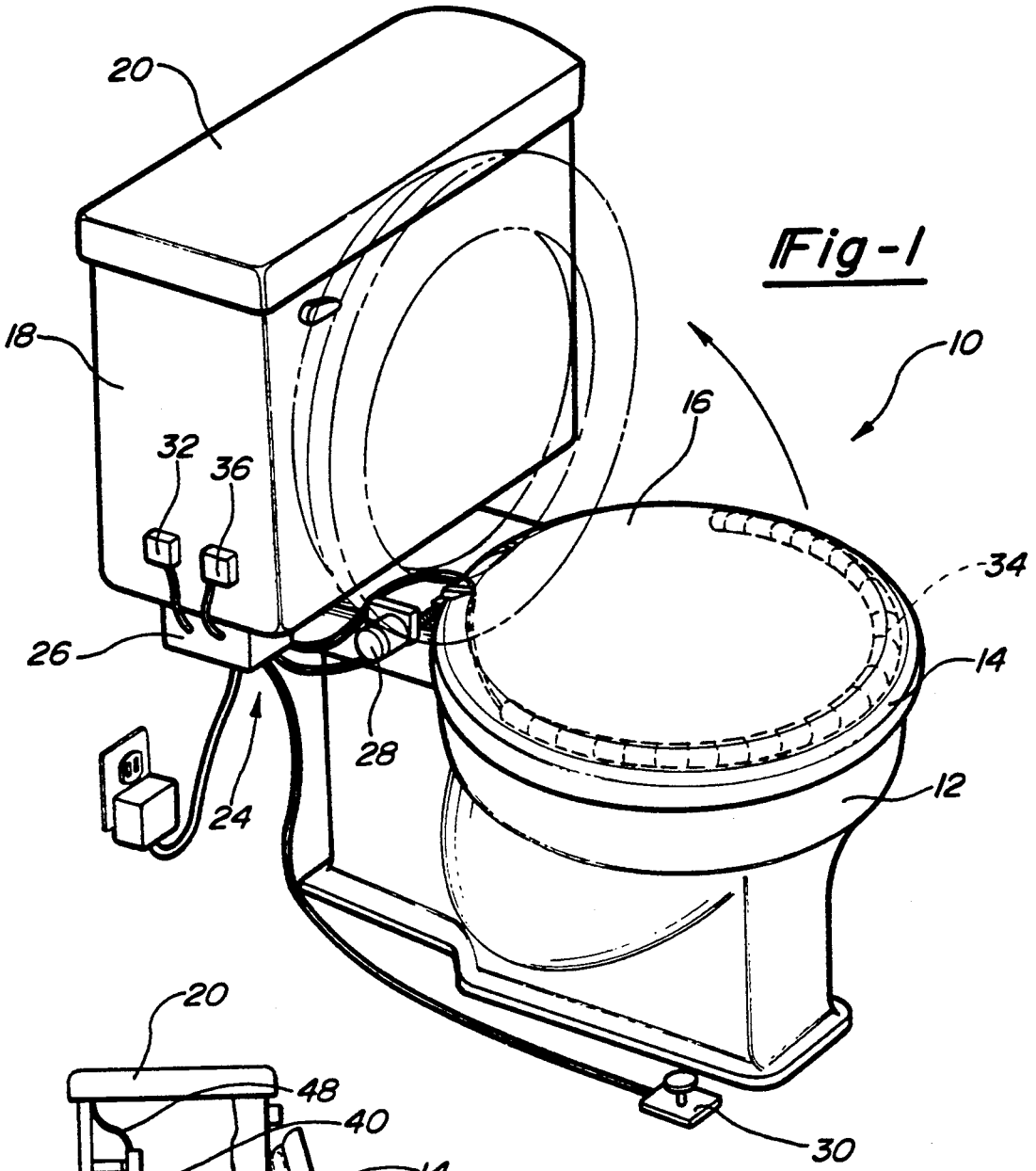
FIG. 1 is a perspective view of a toilet incorporating an automatic toilet seat device according to one preferred embodiment of the present invention.
Figure 2:
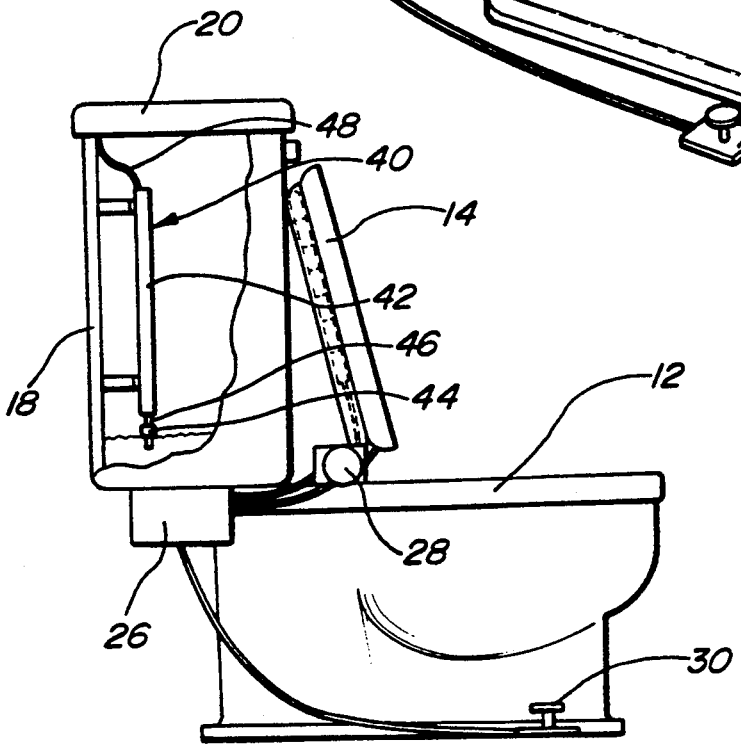
FIG. 2 is a side view of the toilet incorporating the toilet seat device of FIG. 1.

Referring to FIGS. 1 and 2, a toilet 10 is shown including the traditional toilet components of a toilet bowl 12, a toilet seat 14, a toilet bowl lid 16 and a toilet tank 18 having a toilet tank lid 20. The toilet seat 14 and the toilet bowl lid 16 are connected to the toilet bowl 12 in a known manner such that the seat 14 and the lid 16 can articulate relative to the toilet bowl 12 between a raised and lowered position, as is well understood. The toilet seat 14 and the toilet bowl lid 16 are shown in the lowered position, and are further shown in the raised position in phantom. The operation and structural aspects of the toilet 10 can be of any manner known, and thus, these aspects need not be elaborated on here.

According to a preferred embodiment of the present invention, the toilet 10 includes an automatic toilet seat device 24. The toilet seat device 24 includes a control circuit 26, shown here as an electrical box for housing electrical circuitry, and further shown being attached by any suitable means to an undersurface of the toilet tank 18. The toilet seat device 24 further includes an electric motor 28 and a push button switch 30, both being electrically connected to the control circuit 26 by electrical wires, as shown. It will be understood that the control circuit 26 can be of varying sizes and shapes to be in conformity with the electrical circuitry used, and can further be attached to any desirable location on the toilet 10 or a structure adjacent to the toilet 10. The control circuit 26 preferably operates on 12 volts DC, and may include a self contained power source or be operable to convert 120 volts AC from a standard outlet. As shown in FIG. 1, the control circuit 26 receives power from a standard outlet via a step-down transformer.

As will be discussed with specific detail below, the electric motor 28 is operable to either raise or lower the toilet seat 14 depending on an electrical control signal from the control circuit 26. The electric motor 28 can be any suitable motor, preferably being as small as possible to accomplish the desired task. One specific applicable motor is a Dayton 1/200 hp, model YZ835 having a 580:1 gear ratio. The electric motor 28 is operable to rotate in either direction depending on the polarity of the electrical signal from the control circuit 26. A tandem configuration of switches (see FIGS. 3 and 5) is utilized to instruct the control circuit 26 what position the toilet seat 14 is in, and thus, in which direction to rotate the shaft of the motor 28.

The switch 30 will provide an electrical signal to the control circuit 26 in order to instruct the electric motor 28 to either raise or lower the toilet seat 14 depending on its present position. If the toilet seat 14 is in a lowered position, a push of the switch 30 will raise the seat 14, but if the seat 14 is in a raised position, a push of the switch 30 will lower the seat 14. A dual configuration of switches, one to raise the seat 14 and one to lower the seat 14, could also be used. The switch 30 is shown here as a push button floor switch positioned proximate to the toilet bowl 12, but can be incorporated in any desirable location, such as on a wall proximate to the entrance to a bathroom including the toilet 10. Additionally, the switch 30 can be incorporated as part of a remote switch for use in a wireless manner.

If desirable, a sound activated device 32 may be incorporated to either raise or lower the toilet seat 14 by generating an acoustical signal of appropriate intensity and frequency. Such sound activated devices are well known in the art. The sound activated device 32 is shown attached to a side of the toilet tank 18 by any appropriate means, but can be attached at any desirable location on or proximate to the toilet 10. Additionally, the sound activated device 32 is electrically connected to the control circuit 26. By providing the necessary acoustical signal, such as could be accomplished by clapping of the hands, the toilet seat 14 will be either raised or lowered, depending on the manner in which the device 32 is incorporated into the control circuit 26.

The toilet seat device 24 is further operable to lower the toilet seat 14 after the toilet 10 has been flushed. In FIG. 2, the toilet tank 18 is shown partially cut away to expose a float switch 40. The traditional toilet components within the tank 18 are not shown. The float switch 40 includes a tubular portion 42 and a floatable portion 44 which is floatable on the surface of the water within the tank 18 along a shaft 46 only when the water level is below a bottom surface of the tubular portion 42. In other words, once the floatable portion 44 contacts the bottom of the tubular portion 42 and is submerged underwater, it is pinned in this location due to its buoyancy. After the toilet 10 has been flushed, the floatable portion 44 will drop to its lowest level in association with the water level in the tank 18. Once the floatable portion 44 separates from the tubular portion 42 in association with the water in the tank 18, a switch (not shown) within the tubular portion 42 is disengaged. The switch will then send a signal to the control circuit 26 via electrical wires 48 to indicate that the toilet 10 has been flushed. Alternately, the signal can be sent when the floatable portion 44 recontracts the tubular portion 42 after the water level rises. The toilet seat 14 and the toilet lid 16 are shown in a raised position in FIG. 3 even though the water level is indicating a flush has occurred because there is a small delay between the time the switch sends the signal and the time the seat 14 is lowered.

The toilet lid 16 includes an illumination source 34, shown here as an elongated tubular light held in position within an outer covering material of the toilet lid 16. The outer covering is substantially translucent to enable the light to escape. In a preferred embodiment the illumination source 34 is a flex light manufactured by National Specialty Lighting operable to be run on 12

VDC at 0.28 watts and having a diameter of approximately 0.5 inches. Preferably, the illumination source 34 will be associated with one of either the toilet lid 16 or the toilet seat 14. It will be understood, however, that the illumination source 34 can be located in any desirable position, and further, can be of any desirable shape. The illumination source 34 will preferably include some type of photosensitive cell 36 in order to switch on the illumination source 34 at the appropriate time, i.e. when the toilet area is sufficiently dark. The photosensitive cell 36 is depicted here as being attached to the toilet tank 18, by any appropriate means, but also can be attached at any desirable location. The illumination source 34 is operable to run on the 12 volt DC power from the control circuit 26, as will be discussed below, or can be operable to run on a separate AC source.

Figure 3:
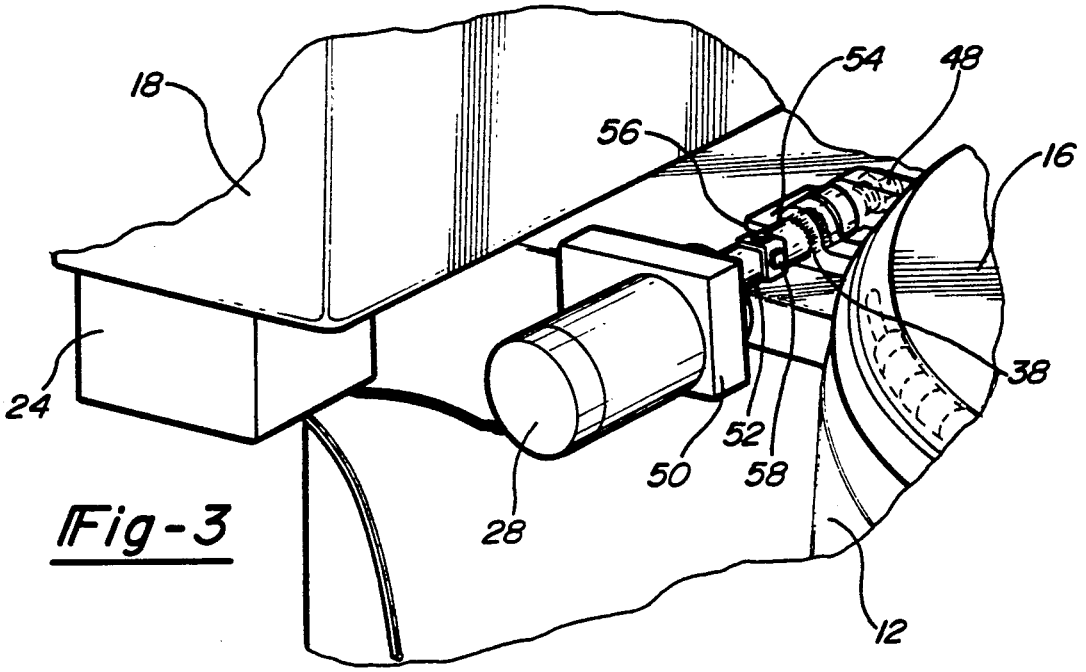
FIG. 3 is a close-up perspective view of the toilet seat device of FIG. 1.

Now turning to FIG. 3, a close-up perspective view of the toilet seat device 24 is shown. As shown, the electrical motor 28 includes a gear box 50 and a motor shaft 52. The shaft 52 extends from the gear box 50 and is engagable with a connecting section 54 of the toilet seat 14 at a point substantially where the toilet seat 14 articulates relative to the toilet bowl 12. In a preferred arrangement, a bolt 48 extends through the connecting section 54 substantially along an axis of the shaft 52 such that extension spleens 38 extending from the shaft 52 engage both the bolt 48 and the connecting section 54 as shown. The method of connection between the shaft 52 and the connecting section 54, however, can be of any suitable method such that the toilet seat 14 is rotated on an articulation axis upon rotation of the shaft 52. All of the components included as part of the electrical motor 28, the gear box 50 and the shaft 52 can be incorporated within a common housing (not shown) or on a common platform (not shown).

Additionally, two limit switches 56 and 58 are shown positioned at substantially 90° to each other on the shaft 52. The limit switches 56 and 58 can be any appropriate limit switches known in the art such as mercury switches, etc. The limit switches 56 and 58 will be electrically connected to the control circuit 26 by means of wires (not shown). The operation of the switches 56 and 58 is known in the art, and as used here provides an indication as to the position of the shaft 52. In other words, when the shaft 52 is rotated, one of the switches 56 or 58 will be closed while the other will be opened. Thus, when the toilet seat 14 is in a raised position the limit switch 56 will be closed, and when the toilet seat 14 is in a lowered position the limit switch 58 will be closed. Consequently, the control circuit 26 will know in what position the toilet seat 14 is in, whether raised or lowered. It is noted that in this specific arrangement, the toilet seat 14 and the toilet bowl lid 16 will be raised together by the motor 28, but only the toilet seat 14 will be lowered by the motor 28. Additionally, a clutch mechanism (see FIG. 6) can be incorporated in order to enable the toilet seat 14 to be raised or lowered manually when the mechanism is attached to the shaft 52 of the electric motor 28.

Now turning to FIG. 4, a detailed discussion of the operation of the toilet seat device 24 set forth above will be given with specific reference to an electrical circuit 68. The electrical circuit 68 can be separated into five distinct electrical circuits operating off a common power supply 72. Specifically, those circuits are a motor circuit 76, an acoustical circuit 70, an illumination circuit 78, a seat raising circuit 80, and a seat lowering circuit 82. Each of these circuits makes up a substantial portion of the control circuit 26, above. Upon closing of a master switch 74, each of these circuits will receive power from the power source 72. The power source 72 may be housed with control circuit 26 and as such can be any applicable 12 volt DC power source, as discussed above, but is shown here receiving a 120 volt AC signal from a standard outlet.

Specifically referring to the illumination circuit 78, the components and operation of this circuit will be discussed first. The circuit 78 is generally separate from the operation of the remaining circuits 70, 76, 80 and 82. The circuit 78 includes a photosensitive cell 84 and an illumination source 86, each connected in series with a load resistor $R_L$. The photosensitive cell 84 is analogous to the photosensitive cell 36 and the illumination source 86 is analogous to the illumination source 34, above. The photosensitive cell 84 can be any known cell which will be sensitive to ambient light, and will further close an electrical connection when the ambient light diminishes below a predetermined intensity level, as is well known in the art. Assuming the master switch 74 is in a closed position and the ambient light is sufficiently low, electric current will then reach the illumination source 86 from the power supply 72 such that it will be ignited. It is noted that a separate switch, other than the master switch 74, can be incorporated within the circuit 78 such that the operation of the illumination circuit 78 can be controlled separately from the remaining circuits. Alternately, the photosensitive cell 84 can be removed such that the illumination source 86 is operated merely by a manual switch.

The acoustical circuit 70 includes an E-relay coil 62 electrically connected in series with a sound activated device 64. The sound activated device 64 is analogous to the sound activated device 32 above and is operable to close a contact upon receiving an acoustical signal of a frequency and intensity within a specific range. Sound activated devices of this type are known in the art and as such need not be discussed in detail here. Assuming the master switch 74 is in a closed position and the sound activated device 64 receives an appropriate acoustical signal, the E-relay coil 62 will be energized which will in turn close a set of E-relay contacts 66 associated with the seat lowering circuit 82. The closing of the E-relay contacts 66 is thus operable to lower the toilet seat 14, as will be discussed in greater detail below. It is noted, however, that the E-relay contacts 66 can also be included in the seat raising circuit 80 in order to raise the seat 14 at the initiation of a desirable acoustical signal.

The motor circuit 76 includes switch contacts 88 of a double pole double throw D-relay, normally open B-relay holding contacts 90, and an electrical motor 92. The motor 92 is analogous to the electrical motor 28, above. Since the motor 92 must rotate in both directions in order to raise and lower the toilet seat 14, the switch contacts 88 of the D-relay provides a mechanism by which the polarity of the power supply 72 can be reversibly applied to the motor 92 to cause it to rotate in alternate directions. More particularly, when the motor 92 is to be rotated in one direction, the positive and negative inputs must be applied to one side of the motor 92, and when the motor 92 is to be rotated in the opposite direction, the polarity must be reversed. The switch contacts 88 of the D-relay are shown in their normal unenergized position such that if the holding contacts 90 were closed, the motor 92 would receive power to rotate the motor 92 to raise the toilet seat 14. When the contacts 88 are switched, the polarity is reversed, and the motor 92 will rotate to lower the toilet seat 14.

The seat raising circuit 80 includes a push button switch 100, analogous to the switch 30, above, connected in series with a normally closed C-relay interlock 94, an A-relay coil 102, a B-relay coil 104 and a seat lowered switch 106, analogous to the limit switch 58, above. Additionally, the A-relay coil 102 and the B-relay coil 104 are connected in parallel, and a set of normally open A-relay holding contacts 108 are connected in parallel with the switch 100. If both the master switch 74 and the seat lowered switch 106 are in closed positions, and the push button switch 100 is depressed, both of the coils 102 and 104 will be energized. Additionally, the contacts 108 and 90 will be closed, thus maintaining both the A-relay coil 102 and the B-relay coil 104 energized and enabling the motor 92 to raise the toilet seat 14. Furthermore, a normally closed A-relay interlock 124 is opened, thus disabling the seat lowering circuit 82. If, however, the switch 106 is open (indicating that the seat 14 is already up), the A-relay coil 102 and the B-relay coil 104 will not be energized regardless if the push button switch 100 is depressed. Thus the motor 92 will not attempt to raise the toilet seat 14. When the toilet seat 14 reaches its raised position, the switch 106 will be opened thus deenergizing the A-relay coil 102 and the B-relay coil 104, and opening the contacts 108 and 90 causing the motor 92 to stop rotating. Furthermore, once the toilet seat 14 reaches its raised position, a seat raised switch 116 will be closed, but the push button 30 will be open, and thus, the seat 14 will not be lowered.

The seat lowering circuit 82 also includes a push button switch 110, analogous to the switch 30, above, positioned in series with the normally closed A-relay interlock 124, a C-relay coil 112, a D-relay coil 114 and the seat raised switch 116. Additionally, positioned in parallel with the push button switch 110, is a float switch 118, analogous to the float switch 40, above, a set of normally open C-relay holding contacts 120 associated with the C-relay coil 112, the E-relay contacts 66, and an optional timing circuit 122. Assuming that the master switch 74 and the switch 116 are closed, and either push button switch 110 is depressed or the float switch 118 is closed, the C-relay coil 112 and the D-relay coil 114 will be energized such that the C-relay contacts 120 will be closed in order to maintain power to the C-relay coil 112 and the D-relay coil 114. When the D-relay coil 114 is energized, the contact switches 88 associated with the D-relay are switched causing the polarity of the motor 92 to be reversed, and thus, lowering the toilet seat 14. Furthermore, the interlock 94 is opened, thus disabling the seat raising circuit 80. When the toilet seat 14 reaches its lowered position, the switch 116 will be opened, thus deenergizing the C-relay coil 112 and the D-relay coil 114 causing the motor 92 to stop rotating.

Figure 4:
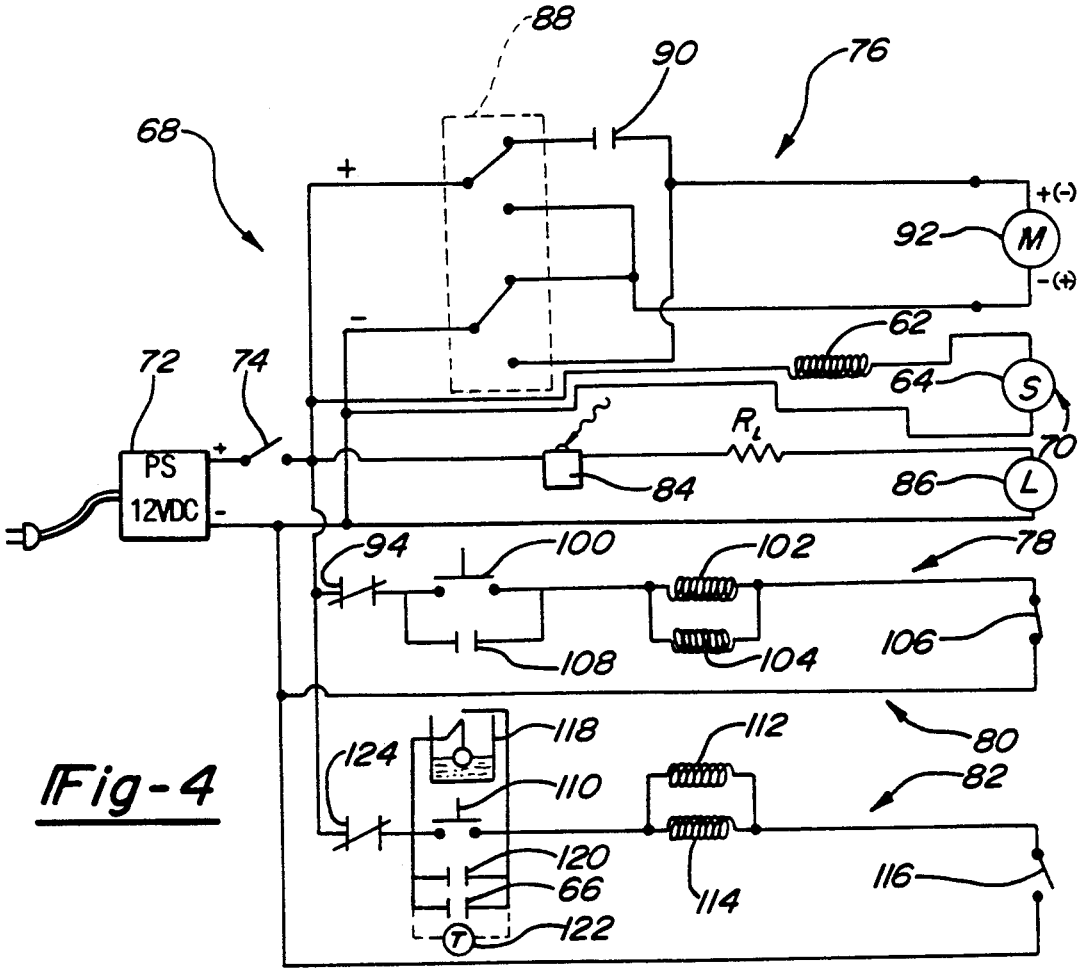
FIG. 4 is a circuit diagram of the operation of the automatic toilet seat device according to one preferred embodiment of the present invention.

The circuit configuration of FIG. 4 as shown depicts the toilet seat 14 in a lowered position. Assuming that the master switch 74 is then closed and a user wishes to raise the toilet seat 14, the user will depress the switch 30 which will activate the push button switches 100 and 110. If the toilet seat 14 is indeed in a lowered position, the switch 106 will be closed, and thus, both the A-relay coil 102 and the B-relay coil 104 will be energized causing the normally open contacts 90 and 108 to close and the normally closed interlock 124 to open. Because the normally closed interlock 124 is opened, and because the switch 116 is open, the C-relay coil 112 and the D-relay coil 114 will not be energized. Consequently, power will be applied to the motor 92 in the proper polarity such that the shaft 52 of the motor 28 will rotate in a clockwise direction, thus raising the toilet seat 14.

Once the toilet seat 14 reaches its upright position, the switch 106 will be opened and the switch 116 will have already been closed. Accordingly, if the user then desires to return the seat 14 to its lowered position, he can again depress the switch 30, closing the switch 110, such that the C-relay coil 112 and the D-relay coil 114 are energized, closing the C-relay contacts 120, opening the interlock 94 and switching the D-relay switches 88, thus reversing the polarity of the motor 92 in order to lower the toilet seat 14. Because the switch 106 is open when the toilet seat 14 is in a raised position and the interlock 94 is open, the A-relay coil 102 and the B-relay coil 104 will not be energized. Additionally, the user can activate the sound device 64 by clapping his or her hands, or performing some other appropriate sound.

If, however, the user does not return the toilet seat 14 to its lowered position by depressing the switch 30, the toilet seat 14 will be automatically lowered after the flush action of the toilet 10. If the toilet seat 14 is up, the switch 106 is opened and the switch 116 is closed. Consequently, if the float switch 118 is closed once the float 40 closes the switch 42, the C-relay coil 112 and the D-relay coil 114 will be energized, thus again switching the polarity of the motor 92 to rotate the shaft 52 in a counter clockwise direction in order to lower the toilet seat 14. Furthermore, if the user fails to flush the toilet 10, and further leaves the toilet seat 14 in a raised position, the timing device 122 will automatically close a contact to apply current to the C-relay coil 112 and the D-relay coil 114 a predetermined time interval after the toilet seat 14 has been raised. The timing device 120 is repeatedly cycling through a set interval, and each time it reaches the end of the interval it will momentarily close a set of contacts to enable power to get to the C-relay coil 112 and the D-relay coil 114. Therefore, assuming the switch 116 is closed indicating that the seat 14 is raised, the seat 14 will be automatically lowered.

Figure 5:
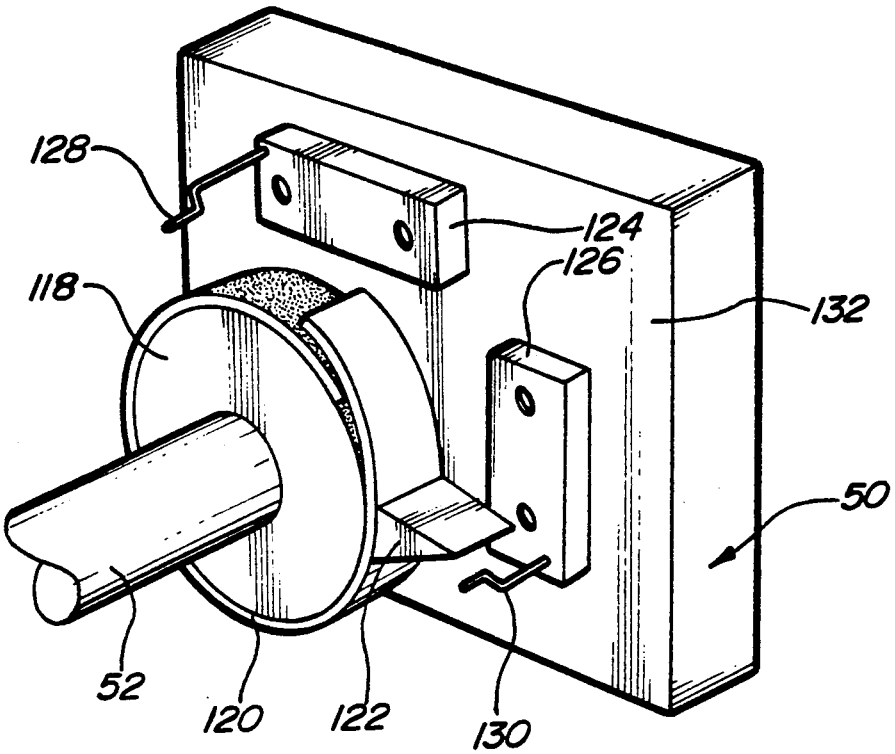
FIG. 5 is a perspective view of a switching mechanism of the automatic toilet seat device according to one preferred embodiment of the present invention.

The method in which the automatic toilet seat device 24 knows if the toilet seat 14 is in a raised or lowered position can be accomplished by a variety of different methods. Turning to FIG. 5, a second embodiment of performing this task is shown. In this figure, the gear box 50 of the motor 28 is shown in a perspective view from an angle substantially opposite to that of FIG. 3, where the motor shaft 52 extends inwardly. The shaft 52 includes a barrel portion 118 in which a removable member 120 is shown rigidly attached to an outer perimeter of the barrel portion 118. The removable member 120 includes a protrusion member 122 extending radially out from the barrel portion 118. The removable member 120 is removable from the shaft 52 such that the protrusion member 122 can be repositioned on the barrel portion 118 in a desirable location, as will be discussed below. In a preferred embodiment, the removable member 120 is a strip of plastic material including a a loop and hook material, such as VELCRO® such that the removable member 120 can be easily wrapped around the barrel portion 118 and held there in a desirable position by the loop and hook material.

Connected to one surface 132 of the gear box 50 is a seat up switch 124 and a seat down switch 126. The method of connection can be by any suitable means, and as shown here is by screws. Each of the switches 124 and 126 are shown as elongated rectangular switches connected to the gear box 50 substantially perpendicular to each other. The switches 124 and 126 are electrically connected to the control circuit 26 by electrical wires (not shown). The seat up switch 124 and the seat down switch 126 each include a switch extension member 128 and 130, respectively. The switch extension members 128 and 130 extend from their respective switches 124 and 126 in a direction in which the shaft 52 extends such that the protrusion member 122 will contact the extension members 128 and 130 if the shaft 52 rotates far enough in the respective direction. Additionally, a magnetic attachment between one of either of the extension members 128 and 130 and the protrusion member 122 can be utilized for a more secured engagement. Consequently, when either of the extension members 128 and 130 is tripped, the control circuit 26 will know in what position the toilet seat 14 is in and can appropriately disengage the motor 28. Therefore, by visualizing the switch 124 as switch 106 and the switch 126 as switch 116 above, it becomes apparent how the switches 124 and 126 operate in the circuit 70.

Figure 6:
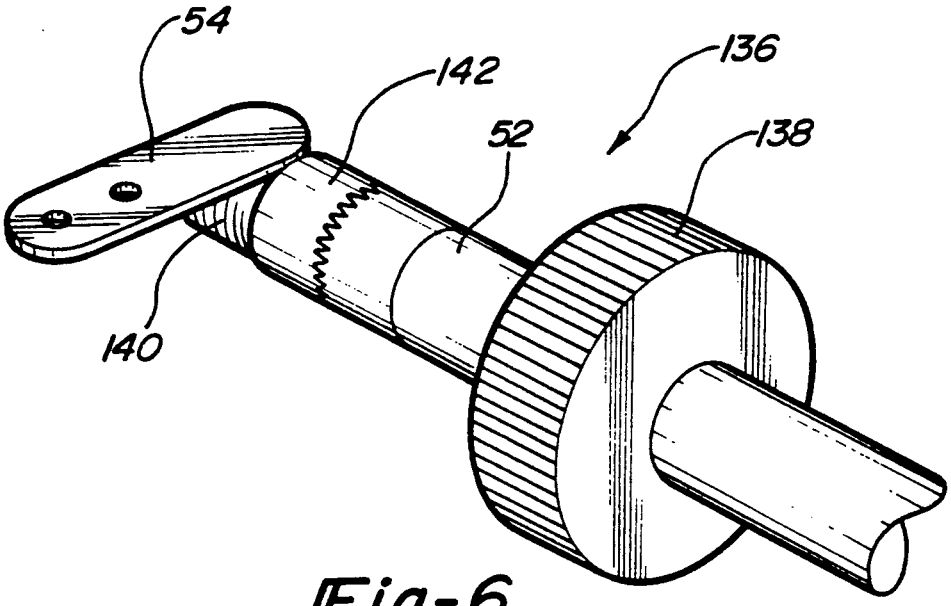
FIG. 6 is a perspective view of a clutch mechanism of the automatic toilet seat device according to one preferred embodiment of the present invention.

Now turning to FIG. 6, a clutching mechanism 136 operable to be used in conjunction with the motor shaft 52 will be discussed. By including the clutching mechanism 136 in association with the shaft 52 of the electrical motor 28 discussed above, it is possible to lower or raise the toilet seat 14 by a manual operation when the shaft 52 is rigidly connected to the connecting section 54 and the motor 28. The clutching mechanism 136 is comprised of a cylindrical section 138 which houses the actual clutch device. The cylindrical section 138 is positioned around the shaft 52 such that if an excessive force attempts to rotate the shaft 52, as would happen from a manual intervention, the clutching mechanism will disengage allowing section 140 of the shaft 52 to rotate. A variety of different clutching mechanisms are known in the art, many of which would be applicable here, and as such need not be detailed. Also shown is a disengaging mechanism 142 which allows the toilet seat 14 to be disengaged from the device 24 if desired. The disengaging mechanism 142 can be any appropriate device which allows the shaft 52 to be separated from the connection section 54.

Figure 7:
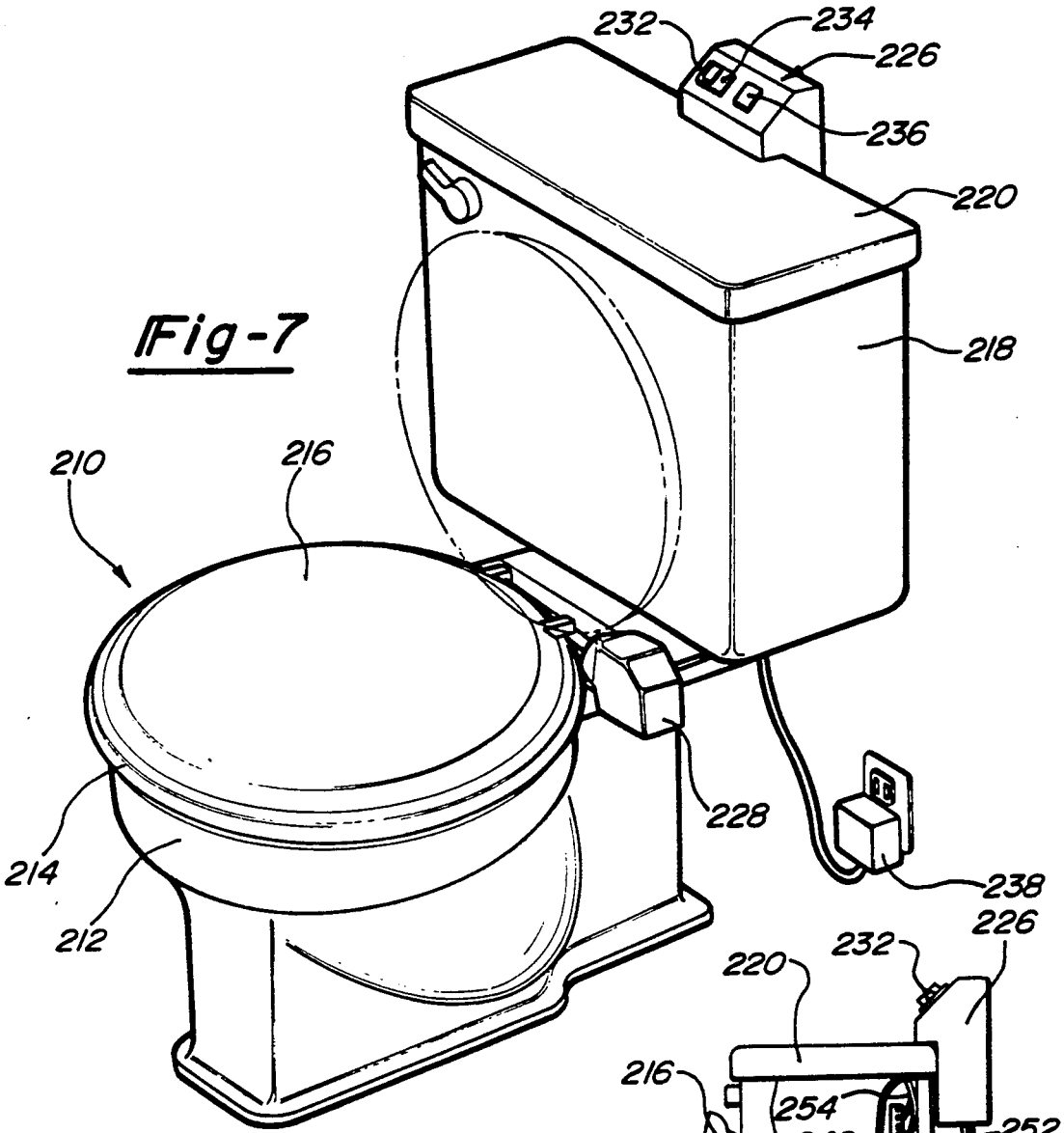
FIG. 7 is a perspective view of a toilet incorporating an automatic toilet seat device according to another preferred embodiment of the present invention.
Figure 8:
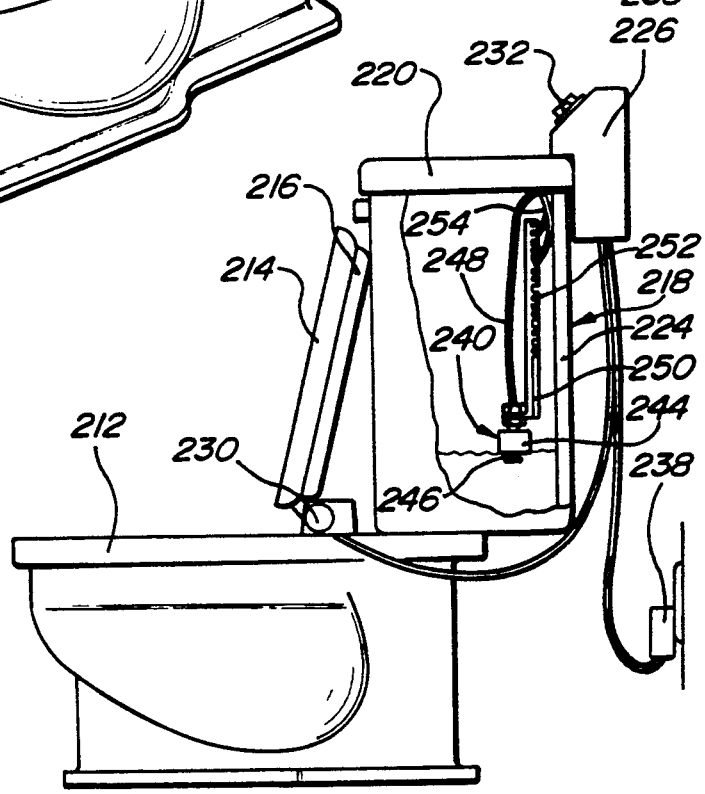
FIG. 8 is a side view of the toilet incorporating the toilet seat device of FIG. 7.

Turning to FIGS. 7 and 8, an alternate automatic toilet seat device associated with a toilet 210 according to another preferred embodiment is shown. The toilet 210 includes the traditional toilet components of a toilet bowl 212, a toilet seat 214, a toilet bowl lid 216 and a toilet tank 218 having a toilet tank lid 220. The toilet seat 214 and the toilet bowl lid 216 are shown in a lowered position, and are further shown in a raised position in phantom. The operation and structural aspects of the toilet 210 can be of any manner known, and thus, these aspects need not be elaborated on here.

The toilet seat device includes a control unit 226, shown here as a housing for enclosing electrical circuitry, and further shown being attached to a back wall 224 of the toilet tank 218 in a manner as will be discussed below. The toilet seat device further includes a motor housing 228 for enclosing a motor 230 (FIG. 8). The motor 230 is electrically connected to the control unit 226 by electrical wires, as shown. The control unit 226 includes an activation switch 232 and a display lamp 234 such as a light emitting diode. Further, the control unit 226 could include a jack for accommodating a foot switch in the manner as discussed above. Additionally, a night lamp 236 and associated photocell (not shown) can be included with the control unit 226. It will be understood that the control unit 226 can be of varying sizes and shapes to be in conformity with the electrical control circuitry, and can further be attached to any desirable location on the toilet 210 or a structure adjacent to the toilet 210. In one embodiment, the control unit 226 is an electrical box secured in a wall much in the same manner as a standard AC outlet box or switch box. The control circuit 226 preferably is operable to convert 120 volts AC from a standard outlet, but may include a self contained DC power source. As shown in FIG. 1, the control circuit 226 receives power from a standard AC outlet via a step-down transformer 238.

As will be discussed with specific detail below, the electric motor 230 is operable to rotate in both directions to either raise or lower the toilet seat 214 depending on the polarity of an electrical control signal applied to the motor 230 from the control unit 226. The electric motor 230 can be any suitable motor, preferably being as small as possible to accomplish the desired task. One specific applicable motor is a Dayton 1/200 hp, model YZ835 having a 580:1 gear ratio. The switch 232 will provide an electrical signal to the control unit 226 in order to instruct the electric motor 228 to either raise or lower the toilet seat 214 depending on its present position. If the toilet seat 214 is in a lowered position, a push of the switch 232 will raise the seat 214, but if the seat 214 is in a raised position, a push of the switch 232 will lower the seat 214.

The toilet seat device is further operable to lower the toilet seat 214 after the toilet 210 has been flushed. In FIG. 8, the toilet tank 218 is shown partially cut away to expose a float switch 240. The traditional toilet components within the tank 218 are not shown. The float switch 240 includes a floatable portion 244 which is floatable on the surface of the water within the tank 218 along a shaft 246 only when the water level is below a bottom surface of an L-shaped bracket 250. In other words, once the floatable portion 244 contacts the bracket 250 and is submerged underwater, it is pinned in this location due to its buoyancy. After the toilet 210 has been flushed, the floatable portion 244 will drop to its lowest level in association with the shaft 246. Once the floatable portion 244 separates from the bracket 250 in association with the water level in the tank 218, a magnet (not shown) within the floatable portion 244 causes a reed switch (not shown) within the shaft 246 to be activated. The reed switch will then send a signal to the control circuit 226 via electrical wires 248 to indicate that the toilet 210 has been flushed. Alternately, the signal can be sent when the floatable portion 244 recontracts the bracket 250 after the water level rises. The toilet seat 214 and the toilet lid 216 are shown in a raised position in FIG. 3 even though the water level is indicating a flush has occurred because there is a delay between the time the switch 240 sends the signal and the time the seat 214 is lowered. A float switch which operates in this fashion is commercially available from Signal Systems International of Lavalette, N.J., Model No. FS2A.

The position of the float switch 240 is adjustable within the tank 218. Specifically, the float switch 240 is adjustable by the L-shaped bracket 250. The bracket 250 includes a series of holes 252 along a surface of the bracket 250 adjacent the back wall 224 of the tank 218. A bracket clip 254 hooks over the back wall 224 of the tank 218 and has legs which are inserted into the holes 252 such that if the legs are inserted into different holes, the level of the float switch 240 within the tank 218 can be adjusted. The specifics of the clip 254 and bracket 250 will be discussed in greater detail below with reference to FIGS. 12A and 12B.

Figure 9:
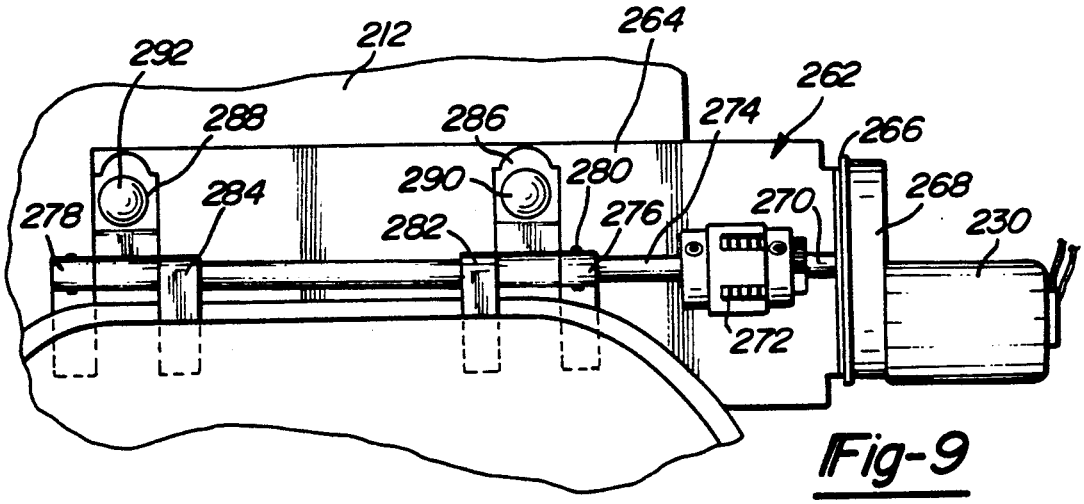
FIG. 9 is a top view of a motor, a clutching mechanism and a drive shaft as part of the automatic toiled seat device of FIG. 7.

Now turning to FIG. 9, a top view of a portion of the toilet seat device is shown. In a preferred embodiment, the toilet seat 214, the toilet lid 216 and the motor 230 and housing 228 are part of a common unit secured to a single support member 262. The support member 262 includes a horizontal plate portion 264 and a vertical plate portion 266. The electrical motor 230 includes a gear box 268 secured to the vertical plate portion 266 by a set of bolts or the like. A motor shaft 270 extends from the gear box 268 and is engagable with a clutch mechanism 272.

A drive shaft 274 extends from the clutch mechanism 272 through tab portions 276 and 278 connected to the toilet seat 214. The tab portions 276 and 278 are rigidly secured to the shaft 274 by means of set screws 280 such that when the shaft 274 rotates, the toilet seat 214 will be pivoted. Even though the toilet seat 214 is rigidly secured to the shaft 274, the toilet seat 214 can be manually articulated relative to the toilet bowl 212 by the clutching mechanism 272. In a preferred embodiment, the clutch mechanism 272 is a slip-ease Polyclutch® commercially available from Custom Products Corporation of North Haven, Conn.

The shaft 274 also extends through tab portions 282 and 284 associated with the toilet lid 216. In this case, however, the tab portions 282 and 284 are loosely secured to the shaft 274 so that the toilet lid 216 can articulate relative to the shaft 274. In other words, the toilet lid 216 is operable to be raised or lowered without rotating the shaft 274. As is obvious, when the toilet seat 214 is raised by the motor 230, the toilet lid 216 will also be raised. Tab portions 286 and 288 are rigidly secured to the shaft 274 and are bolted by means of bolts 290 and 292 to the toilet bowl 212 through the support member 262 such that the toilet lid 216, the toilet seat 214, the motor 230 and the clutching mechanism 272 are all secured to the toilet bowl 212.

Figure 10A:
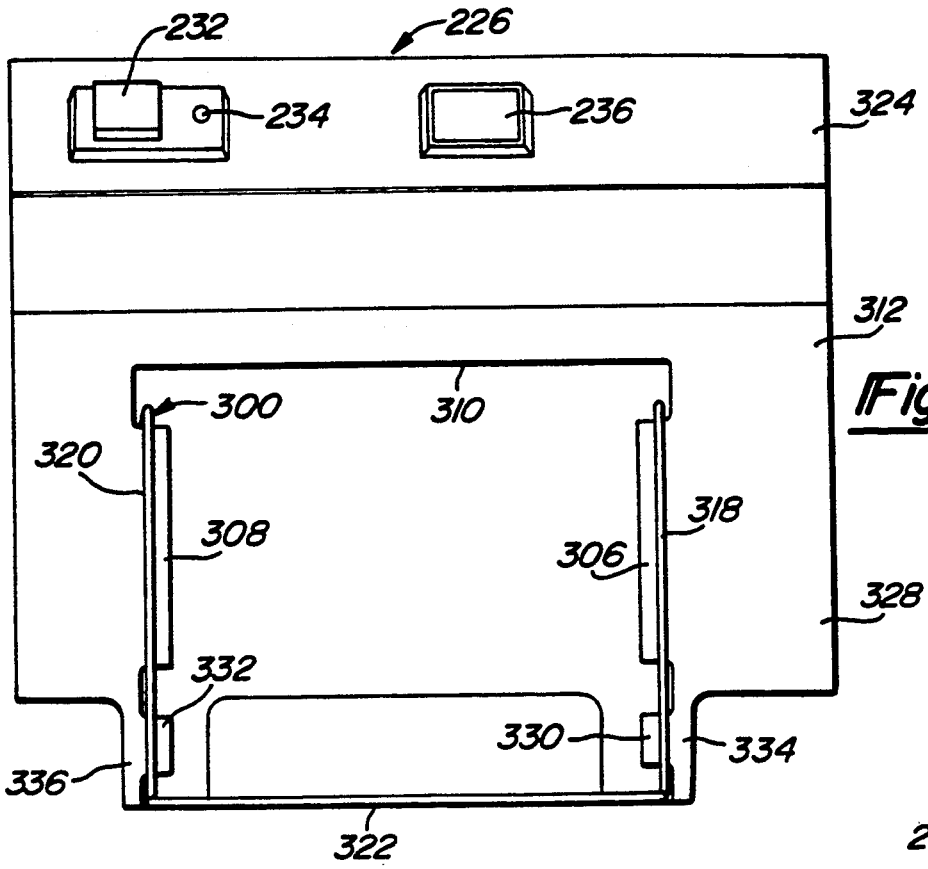
FIGS. 10A and 10B are front and side views of a control device associated with the automatic toilet seat device of FIG. 7.
Figure 11A:
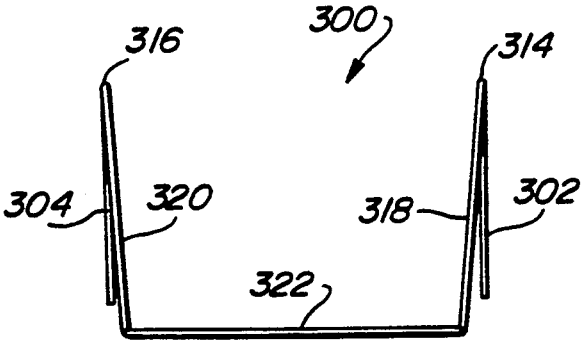
FIGS. 11A and 11B are a front and side view of a bracket for clipping the control device of FIG. 10 to a toilet tank.
Figure 11B:
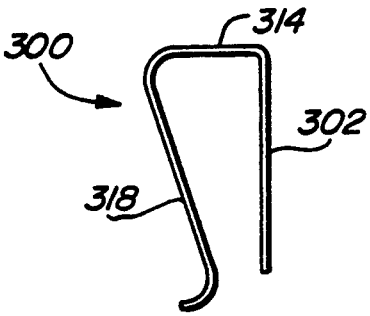
Figure 10B:
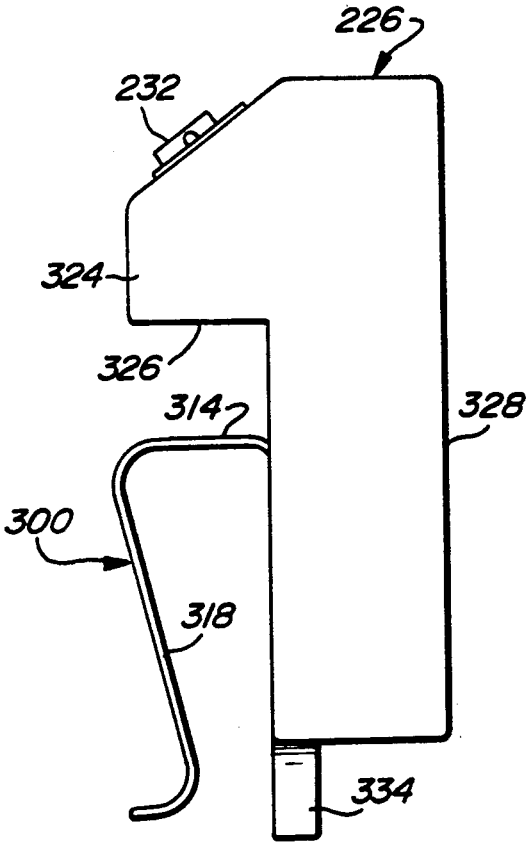

Now turning to FIGS. 10A and 10B, the control unit 226 is shown in a front view and a side view, respectively. In order for the control unit 226 to be connected to the back wall 224 of the toilet tank 218, a clipping bracket 300 is provided. As shown more clearly in FIGS. 11A and 11B, the clipping bracket 300 includes a first leg portion 302 and a second leg portion 304. The first and second leg portions 302 and 304 are positioned behind tab portions 306 and 308, respectfully. The tab portions 306 and 308 extend from the sides of an indented portion 310 in a front face 312 of the control device 226. A first extended portion 314 and a second extended portion 316 extend from the leg portions 302 and 304, respectively, and are adaptable to rest on a top surface of the tab portions 306 and 308. When the control unit 226 is clipped to the toilet tank 218, the extended portions 314 and 316 rest on a top surface of the back wall 224. Additionally, the extended portions 314 and 316 will be forced against a top surface of the indented portion 310. A third leg portion 318 and a forth leg portion 320 extend from the extended portions 314 and 316, respectively, and are connected together by a front extended portion 322. The front extended portion 322 and the leg portions 318 and 320 are positioned within the tank 218 when the control unit 226 is clipped to the toilet tank 218.

The control unit 226 includes an extended top portion 324 which is adaptable to be positioned on top of the toilet tank lid 220 (see FIG. 1). In this manner the width of the toilet tank lid 220 is positioned between a bottom surface 326 of the extended top portion 324 and the extended portions 314 and 316 of the bracket 300. If, however, the toilet tank lid 220 does not fit within this space, the bracket 300 can be removed from the opening 310 by flexing the leg portions 302 and 304 towards each other, and be positioned such that the extended portions 314 and 316 of the bracket 300 rest on a top surface of tab portions 330 and 332. The control unit 226 includes extension legs 334 and 336 to accommodate the tab portions 330 and 332.

Figure 12A:
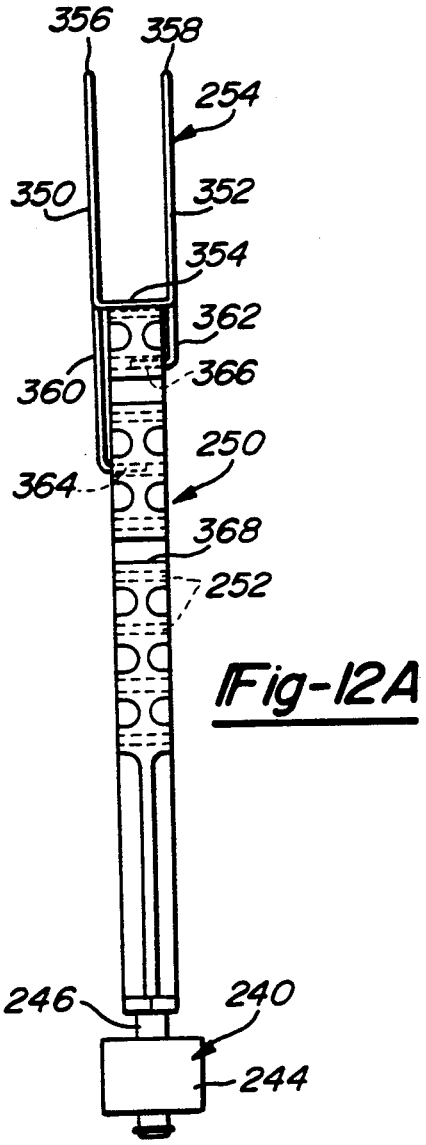
FIGS. 12A and 12B are front and side views of a float switch and associated bracket according to a preferred embodiment of the present invention.
Figure 12B:
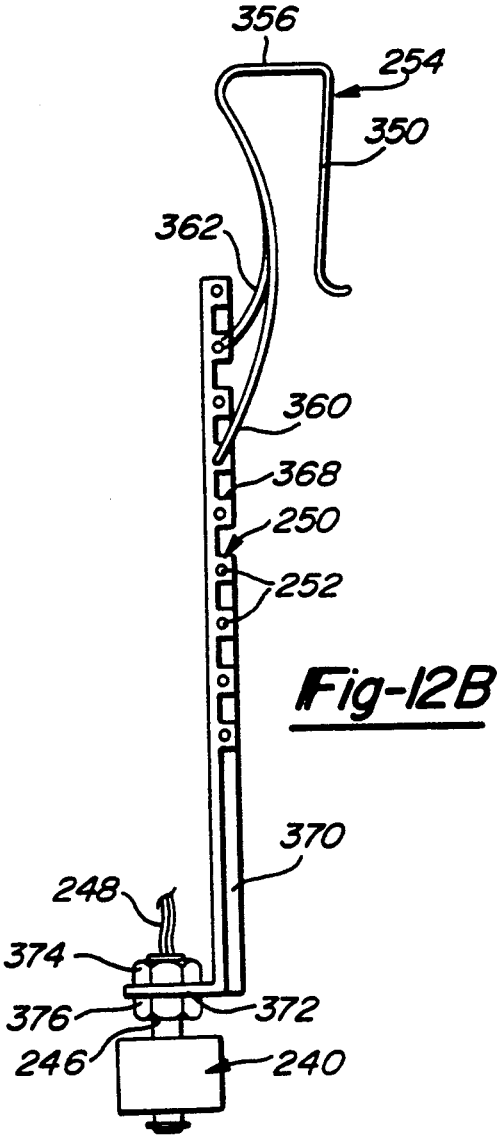

Turning to FIGS. 12A and 12B, a front and side view of the bracket 250 and the bracket clip 254 are shown. The bracket clip 254 includes a first leg portion 350 and a second leg portion 352 which are connected together by an extendable portion 354. A first top portion 356 and a second top portion 358 are connected to the leg portions 352 and 350, respectively, and are adaptable to rest on a top surface of the tank wall 224. Extending from the top portion 356 and the top portion 358 is a third leg portion 360 and a forth leg portion 362, respectively. The leg portions 360 and 362 each include a hook portion 364 and 366, respectively, at an end opposite from the top portion 356 and 358 which are slidably insertable in the holes 252, as shown. By flexing the leg portions 360 and 362, the hook portions 364 and 366 can be removed from one set of holes 252 and selectively engaged in a second set of holes 252 such that the float switch 240 can be adjusted with respect to the water level in the tank 218.

FIG. 12B shows that the bracket 250 includes an extended vertical portion 370 and a horizontal portion 372 on which is secured the float switch 240. A set of bolts 374 and 376 are adaptable to secure the shaft 246 for the portion 372 such that float switch 240 is rigidly held in place. The vertical portion 370 includes a number of indented areas 368 such that the vertical portion 370 can be broken at selected areas in order to fit within different sized tanks.

Figure 13:
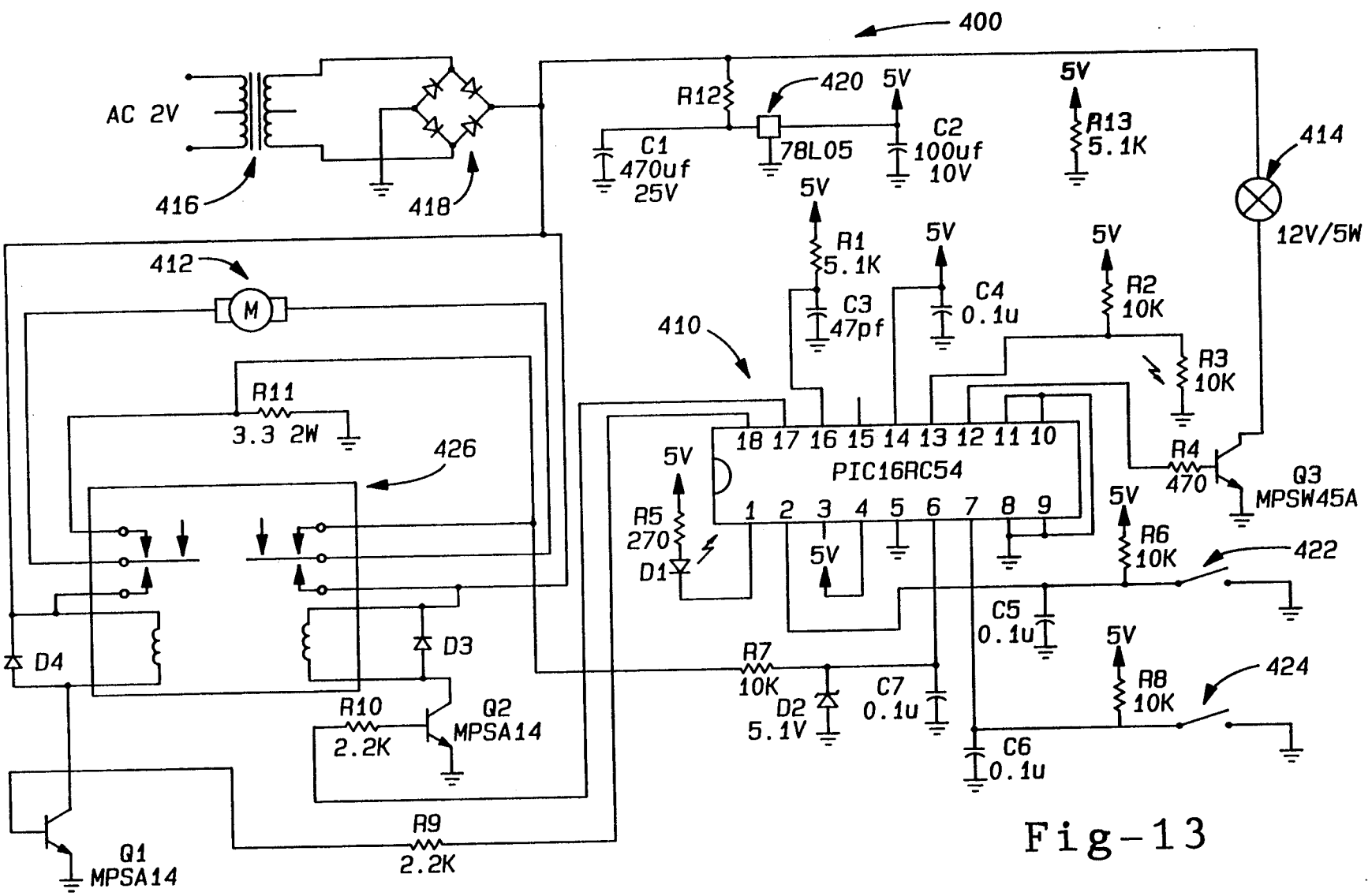
FIG. 13 is a schematic diagram of the control circuit of the automatic toilet seat device according to a preferred embodiment of the present invention.

Turning to FIG. 13, a schematic diagram of a control circuit 400 of the automatic toilet seat device is shown according to a preferred embodiment. The control circuit 400 would be housed in the control unit 226. A microcontroller 410 acts as a central processor for the control circuit 400 such that a motor 412 and a lamp 414 are activated in a desirable fashion. The microcontroller 410 is a commercially available device and, in a preferred embodiment, is an 18 DIP processor no. PIC16RC54, available from Microchip Technology. The motor 412 is a schematic representation of the motor 230, above. Likewise, the lamp 414 is a schematic representation of the night lamp 236.

In order to provide power to the control circuit 400, a 120 V AC line is applied to a 120/12 V transformer 416. The secondary winding of the transformer 416 is connected to a bridge rectifier 418 in order to convert the AC power signal to a DC power signal to be applied to the components of the circuit 400. A 12 V DC output signal is applied to the motor 412 and the lamp 414 from the bridge rectifier 418. However, a voltage regulator 420 is provided in order to drop the 12 V power output from the bridge rectifier 418 to 5 V DC power signal applicable for the microcontroller 410. The operation of transformers, bridge rectifiers and voltage regulators are well-known in the art, and thus need not be discussed here. The transformer 416 and the bridge rectifier 418 can be eliminated and a 12 V DC battery substituted in their place.

A switch 422 represents the activating switch 232 and a switch 424 represents the float switch 240. When the switch 422 is activated, pin 2 of the microcontroller 410 is pulled low which causes pins 17 and 18 of the microcontroller 410 to activate the motor 412 through a relay 426. The relay can be any appropriate relay which performs the desired function. One specific example is a Potter and Brumfield V2R-1001. The switch 424 operates in the same fashion to enable the seat 214 to automatically be lowered when the toilet 210 is flushed after a predetermined delay as programmed in the microcontroller 410.

A high signal on pin 18 and a ground signal on pin 17 will cause the motor 412 to rotate in the direction which will raise the seat 214. Likewise, a ground signal on pin 18 and a high signal on pin 17 will cause the motor 412 to rotate in a direction which will lower the seat 214. In its initial start-up or reset mode, the microcontroller 410 will apply a signal to the pins 17 and 18 such that the seat 214 will be raised. After this initial motor direction, the microcontroller 410 will store in its memory the last polarities applied to the pins 17 and 18 such that the next time the polarities will be reversed, thus causing the motor 412 to rotate in the opposite direction. As will be discussed in greater detail below, if the seat 214 is already up at reset, or is manually lifted or lowered, thus causing the last stored motion of the motor 412 in the microcontroller 410 to be inaccurate, an over-current detection feature will cause the microcontroller 410 to get back on track.

Depending on whether the output of pin 17 or 18 is high, the appropriate transistor Q1 or Q2 will amplify the high signal before it is applied to the relay 426. The operation of the relay 426 is such that depending on which input line the high signal is placed, the appropriate polarity will be applied to the motor 412 in order to cause it to rotate in the desired direction. By studying the input and output lines of the relay 426, as well as the electrical connection of the inductors associated with the relay 426, one can satisfy himself that this will be the case. Diodes D3 and D4 protect the amplifying transistors Q2 and Q1, respectively, so as to prevent the inductors associated with the relay 426 from being discharged too rapidly.

As the motor 412 is either raising or lowering the seat 214, it will eventually reach the toilet bowl 212 or the toilet tank 218 depending on which direction it is rotating. Once this happens, the motor 412 will be prevented from rotating such that excess current is generated in the motion 412 which is detected by the microcontroller 410, and thus, cause it to turn the motor 412 off. Because of this feature, if the seat is either raised or lowered manually such that the last stored polarity of pins 17 and 18 will be inaccurate, the microcontroller 410 will sense over-current immediately, and then cause the motor 412 to reverse its direction. Additionally, a user may stop the motion of the toilet seat 214 at any time by pressing the switch 422 when the seat 214 is moving. Pressing the switch 422 again will reverse the direction of the motor 412 such that if the motor 412 is activated to cause the seat 214 to be either raised or lowered, activation of the switch 422 again will cause the seat 214 to stop in mid-travel, and activation of the switch 422 again will cause it to reverse its direction. The over-current detection also provides a safety feature in that if a child's hand is caught between the toilet seat 214 and the toilet bowl 212, the motor 412 will turn off.

The motor over-current sensing is sensed by a resistor R11 in that if the motor current increases, the resistance through resistor R11 will increase, and a high signal will be generated at pin 6 of the microcontroller 410. A Zener diode D2 is incorporated such that any voltage above 5 volts will be bled to ground in order to protect the microcontroller 410.

A light emitting diode D1, as representative of the lamp 234 above, is provided such that if the diode D1 is illuminated, it indicates that the microcontroller 410 is receiving power. Additionally, if the diode D1 is flashing when the toilet device is activated, this is an indication that the microprocessor 410 is functioning properly.

The lamp 414 is illuminated if light as sensed by a photoresistor R3 is decreased below a predetermined level. When this happens, the resistance in R3 increases which causes pin 13 of the microcontroller 410 to go high such that pin 12 goes high and turns on the switch transistor Q3 such that the lamp 414 can be illuminated.

The microprocessor logic includes a timing window safety feature such that the motor 412 can only run for a predetermined maximum time before the microprocessor 410 shuts the motor 412 off. Further, the microprocessor logic includes short-circuit detection logic which shuts off the motor 412 if the motor poles are short-circuited. The remaining circuit elements as connected are common in the art, and therefore, their function need not be discussed here.

The foregoing discussion discloses and describes merely exemplary embodiments of the present invention. One skilled in the art will readily recognize from such discussion, and from the accompanying drawing and claims, that various changes, modifications, and variations can be made therein without departing from the spirit and scope of the invention as defined in the following claims.

What is claimed is:

1. An apparatus for raising and lowering a toilet seat associated with a toilet, said apparatus comprising:

actuation means for raising and lowering the toilet seat, said actuation means receiving an electrical control signal;

control circuit means for controlling the actuation of the actuation means, said control circuit means sending the control signal to the actuation means in order to cause the actuation means to raise or lower the toilet seat in a desirable fashion;

switch means for causing the control circuit means to actuate the actuating means, said switch means including common contacts alternately causing the control circuit means to cause the actuation means to raise or lower the toilet seat; and float switch means for causing the control circuit means to actuate the actuation means to lower the toilet seat after the flushing action of the toilet.

2. The apparatus according to claim 1 wherein the actuation means is an electrical motor, wherein a shaft extends from the motor and is adapted to be connected to the toilet seat such that rotation of the shaft causes the toilet seat to be raised or lowered.

3. The apparatus according to claim 2 wherein the control circuit means includes current detection means for detecting over-current in the motor, said current detection means detecting over-current in the motor when movement of the toilet seat is impeded such that the control circuit means deactivates the motor.

4. The apparatus according to claim 2 further comprising a clutching mechanism positioned on a shaft between the electrical motor and an articulation point of the toilet seat with the toilet bowl, said clutching mechanism operable to enable the shaft to be rotated by the motor or by manual operation in either direction.

5. The apparatus according to claim 2 wherein the control circuit means includes a light emitting diode, said light emitting diode being illuminated when power is being applied to the control circuit means, said light emitting diode operable to flash when the control circuit activates the electrical motor to indicate that the control circuit means is functioning properly.

6. The apparatus according to claim 2 wherein the motor is configured within a housing.

7. An apparatus for raising and lowering a toilet seat associated with a toilet, said apparatus comprising:

actuation means for raising and lowering the toilet seat, said actuation means receiving an electrical control signal;

control circuit means for controlling the actuation of the actuation means, said control circuit means sending the control signal to the actuation means in order to cause the actuation means to raise or lower the toilet seat in a desirable fashion; and float switch means for causing the control circuit means to actuate the actuation means to lower the toilet seat after the flushing action of the toilet.

8. The apparatus according to claim 7 wherein the control circuit means delays actuation of the actuation means a predetermined time after receiving a flush signal from the float switch means.

9. The apparatus according to claim 7 wherein the float switch means includes an adjustable bracket and clipping mechanism, said clipping mechanism adaptable to be clipped to a toilet tank associated with a toilet and hooked to the bracket in an adjustable fashion such that the position of the float switch means is adjustable within the toilet tank.

10. The apparatus according to claim 1 wherein the control circuit means delays actuation of the actuation means a predetermined time after receiving a flush signal from the float switch means.

11. The apparatus according to claim 1 wherein the control circuit means is microprocessor controlled.

12. The apparatus according to claim 1 further comprising an illumination means for illuminating the toilet, said illumination means including at least one light source.

13. The apparatus according to claim 12 wherein the illumination means further includes a photosensitive resistor, said photosensitive resistor operable to send a signal to the control circuit means whenever the ambient light reaches a predetermined minimum intensity threshold.

14. The apparatus according to claim 12 wherein the at least one light source is positioned on a toilet lid associated with the toilet.

15. The apparatus according to claim 12 wherein the at least one light source is configured in a housing associated with the control circuit means.

16. The apparatus according to claim 1 wherein the float switch means includes an adjustable bracket and clipping mechanism, said clipping mechanism adapted to be clipped to a toilet tank associated with the toilet and hooked to the bracket in an adjustable fashion such that the position of the float switch means is adjustable within the toilet tank.

17. The apparatus according to claim 16 wherein the adjustable bracket includes indented portions such that the bracket can be broken to reduce its length.

18. The apparatus according to claim 1 further comprising sound activating means for causing the control circuit means to actuate the actuation means upon receipt of an appropriate acoustical signal.

19. The apparatus according to claim 1 wherein the toilet seat, a toilet lid and the actuation means are all part of a common as parted on a support member, said support member adapted to be affixed to a toilet.

20. The apparatus according to claim 1 wherein the control circuit means includes short circuit protection means for stopping the activation of the electrical motor if the electrical motor is short circuited.

21. An apparatus for raising and lowering a toilet seat associated with a toilet, said apparatus comprising:

actuation means for raising and lowering the toilet seat, said actuation means receiving an electrical control signal;

control circuit means for controlling the actuation of the actuation means, said control circuit means sending the control signal to the actuation means in order to cause the actuation means to raise or lower the toilet seat in a desirable fashion, wherein the control circuit means is configured within a housing hooked by a clipping mechanism to a toilet tank associated with the toilet; and switch means for causing the control circuit means to actuate the actuation means, said switch means including common contacts alternately causing the control circuit means to cause the actuation means to raise or lower the toilet seat.

22. An apparatus for raising and lowering a toilet seat associated with a toilet, said apparatus comprising:

actuation means for raising and lowering the toilet seat, said actuation means receiving an electrical control signal;

control circuit means for controlling the actuation of the actuation means, said control circuit means sending the control signal to the actuation means in order to cause the actuation means to raise or lower the toilet seat in a desirable fashion, wherein the control circuit means includes timing means for stopping the actuation of the actuation means a predetermined time after the actuation means is activated; and switch means for causing the control circuit means to actuate the actuation means, said switch means including common contacts alternately causing the control circuit means to cause the actuation means to raise or lower the toilet seat.

23. An apparatus for raising and lowering a toilet seat associated with a toilet, said apparatus comprising:

an electrical motor and associated motor shaft, said shaft adapted to be connected to the toilet seat wherein upon rotation of the shaft caused by the electrical motor the toilet seat will be raised or lowered;

control circuit means for controlling the operation of the electrical motor, said control circuit means including current detection means for detecting over-current in the electrical motor, said current detection means detecting over-current in the motor when movement of the toilet seat is impeded such that the control circuit means deactivates the motor, said control circuit means further including timing means for stopping the actuation of the actuation means a predetermined after the actuation means is activated; and switch means for causing the control circuit means to actuate the electrical motor.

24. The apparatus according to claim 23 further comprising float switch means for causing the control circuit means to actuate the electrical motor to lower the toilet seat a predetermined time after the flushing action of the toilet, said control circuit means delaying the actuation of electrical motor a predetermined time after it receives a signal from the float switch means.

25. In the apparatus according to claim 23 further comprising a clutching mechanism positioned on the shaft, said clutching mechanism operable to enable the shaft to be rotated by the motor or by manual operation in either direction.

26. The apparatus according to claim 23 wherein the toilet seat, a toilet lid and the electrical motor are all part of a common assembly supported on a support member, said support member adapted to be affixed to the toilet.

27. An apparatus for raising and lowering a toilet seat associated with a toilet, said apparatus comprising:

actuation means for raising and lowering the toilet seat, said actuation means receiving an electrical control signal;

control circuit means for controlling the actuation of the actuation means, said control circuit means sending the control signal to the actuation means in order to cause the actuation means to raise or lower the toilet seat in a desirable fashion, wherein the control circuit means is configured within a housing, said housing adaptable to be hooked by a clipping mechanism to a toilet tank associated with the toilet; and switch means for causing the control circuit means to actuate the actuating means.

* * * * *

UNITED STATES PATENT AND TRADEMARK OFFICE

CERTIFICATE OF CORRECTION

PATENT NO. : 5,307,524

DATED : May 3, 1994

INVENTOR(S) : Bennie N. Veal

It is certified that error appears in the above-indentified patent and that said Letters Patent is hereby corrected as shown below:

ON THE TITLE PAGE, under References Cited, U.S. Patent Documents, 2,440,231 to Davidson filing date: "10/1944" should be --4/1948--

Column 3, Line 4 "toiled" should be --toilet--

Column 8, Line 63 delete second occurrence of "a"

Column 11, Line 53 "respectfully" should be --respectively--

Column 11, Line 64 "forth" should be --fourth--

Column 12, Line 26 "forth" should be --fourth--

Column 13, Line 55 "motion" should be --motor--

Column 14, Line 13 insert --display-- preceeding "lamp"

Column 15, Line 39 "adaptable" should be --adapted--

Column 16, Line 14 delete "as parted" and insert --assembly supported " therefor

UNITED STATES PATENT AND TRADEMARK OFFICE

CERTIFICATE OF CORRECTION

PATENT NO. : 5,307,524
DATED : May 3, 1994
INVENTOR(S) : Bennie N. Veal

It is certified that error appears in the above-indentified patent and that said Letters Patent is hereby corrected as shown below:

Column 17, Line 5 after "predetermined" insert —time—

Signed and Sealed this

Twenty-first Day of March, 1995

*Attest:*

Bruce Lehman

BRUCE LEHMAN

*Attesting Officer*

*Commissioner of Patents and Trademarks*